US007261293B2

(12) United States Patent
Berger

(10) Patent No.: US 7,261,293 B2
(45) Date of Patent: Aug. 28, 2007

(54) BALL GAME HAVING MEMBERS WITH PASSAGEWAYS

(76) Inventor: Joe Berger, 13952 Laurel Drive, Surrey, British Columbia (CA) V3T 1A9

( * ) Notice: Subject to any disclaimer, the term of this patent is extended or adjusted under 35 U.S.C. 154(b) by 270 days.

(21) Appl. No.: 11/053,908

(22) Filed: Feb. 10, 2005

(65) Prior Publication Data

US 2006/0175749 A1 Aug. 10, 2006

(51) Int. Cl.
*A63F 7/00* (2006.01)

(52) U.S. Cl. ..... 273/118 R

(58) Field of Classification Search ..... 273/108, 273/118 R, 118 A, 119 R, 119 A, 126 R, 273/126 A, 127 R, 127 C
See application file for complete search history.

(56) References Cited

U.S. PATENT DOCUMENTS

| | | | | |
|---|---|---|---|---|
| 480,725 | A | 8/1892 | Hill | |
| 1,223,256 | A | 4/1917 | Coffman | |
| 1,549,038 | A | 8/1925 | Wilson | |
| 1,561,934 | A | 11/1925 | Kennedy | |
| 1,593,421 | A * | 7/1926 | Blum | 273/108.5 |
| D90,462 | S | 8/1933 | Tolman et al. | |
| 2,627,412 | A * | 2/1953 | Bronson | 273/108 |
| 4,026,556 | A * | 5/1977 | Taylor et al. | 273/123 R |
| 4,033,585 | A | 7/1977 | Foreman | |
| 4,560,163 | A * | 12/1985 | Erickson | 273/108.1 |
| 4,790,535 | A | 12/1988 | Droske, Jr. | |
| 5,417,421 | A * | 5/1995 | Bagley | 273/108.5 |
| 5,785,615 | A * | 7/1998 | Kosmalski | 473/471 |
| 5,882,007 | A * | 3/1999 | Gay | 273/108.1 |
| 6,457,711 | B1 * | 10/2002 | Baulesh | 273/108.1 |
| 6,533,272 | B2 * | 3/2003 | Hylak et al. | 273/108.31 |
| 2006/0175749 | A1 * | 8/2006 | Berger | 273/118 R |

* cited by examiner

*Primary Examiner*—Raleigh W. Chiu
(74) *Attorney, Agent, or Firm*—Norman M. Cameron

(57) ABSTRACT

A game apparatus comprises a pair of side rails, a first passageway member having a bottom and a plurality of passageways communicating with the bottom. A second passageway member has a bottom and a plurality of passageways communicating with the bottom. There also is a backstop, the side rails having portions which are mutually engageable with the passageway members and the backstop when the side rails are positioned on a flat surface generally parallel and spaced-apart from each other. The first passageway member, the second passageway member and the backstop are spaced-apart from each other and extend perpendicular to the side rails. There is a plurality of balls, the balls being capable of passing through the passageways of the first and second passageway members when rolled towards the backstop. A number of games are playable by players using the apparatus. The players attempt to roll balls through the passageways of the first passageway member and in some games try to prevent balls from rolling through passageways of the second passageway member. Players peg points by moving markers along spaced apart apertures on the side rails.

12 Claims, 2 Drawing Sheets

Fig. 1
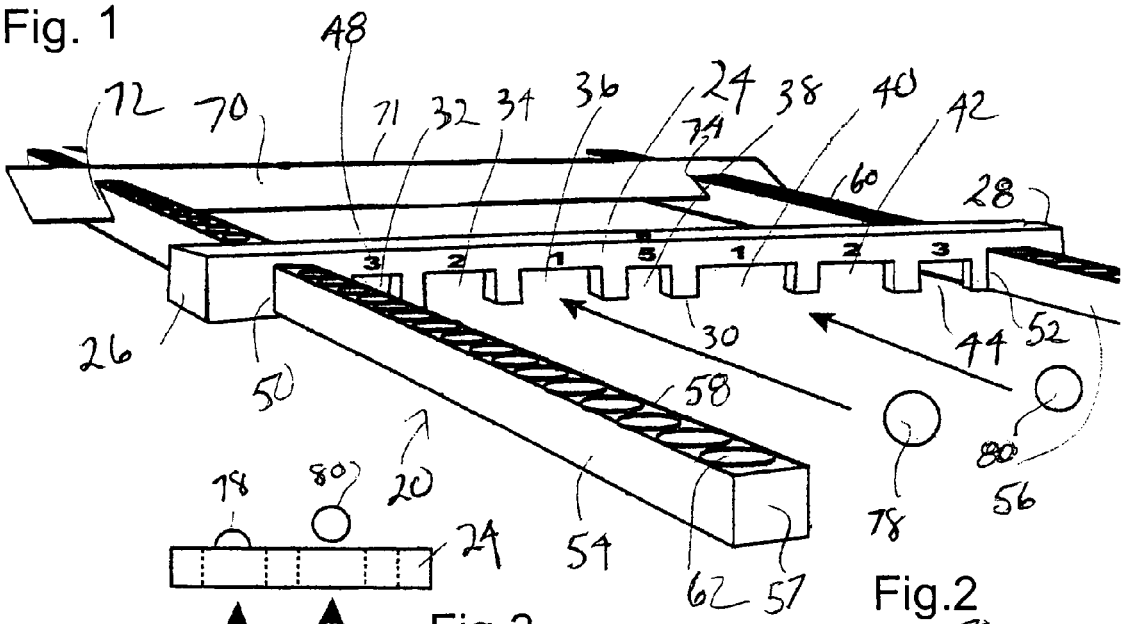
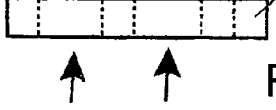
Fig.3
Fig.2
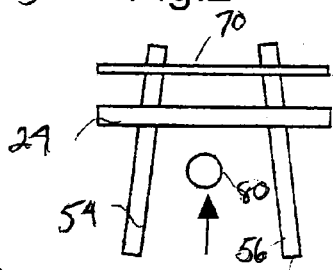
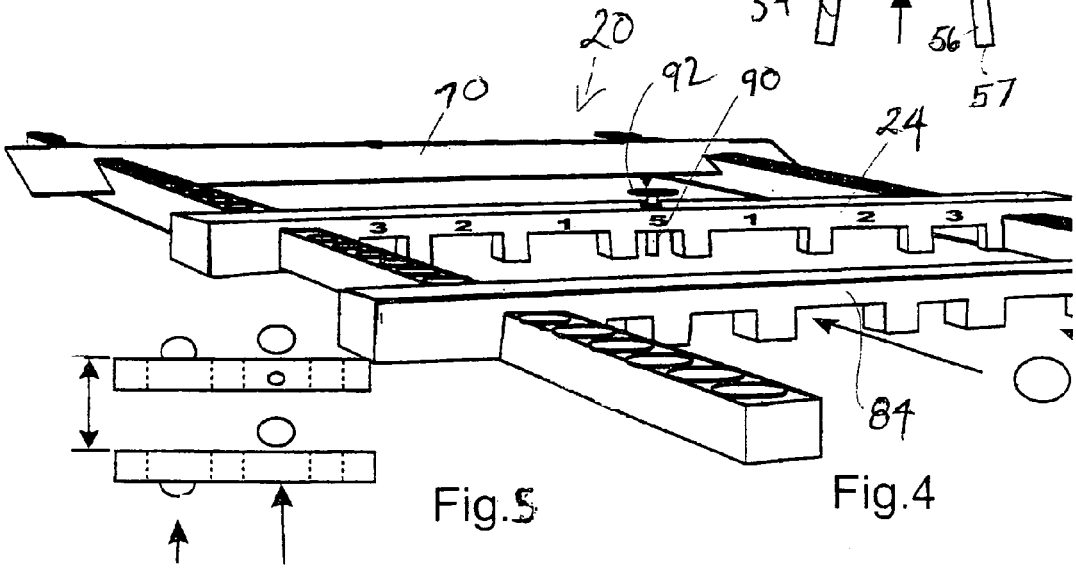
Fig.5
Fig.4

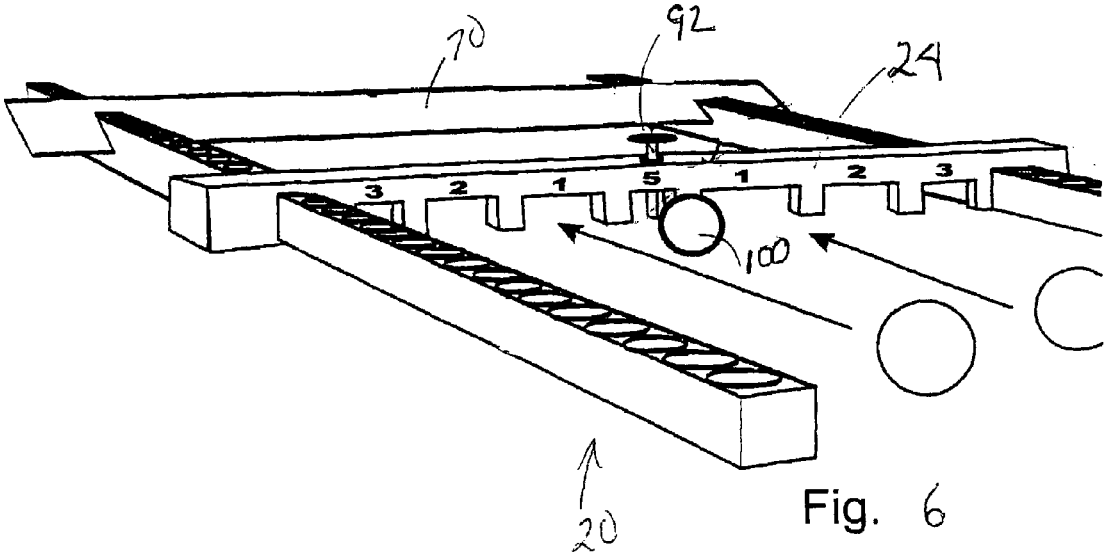
Fig. 6
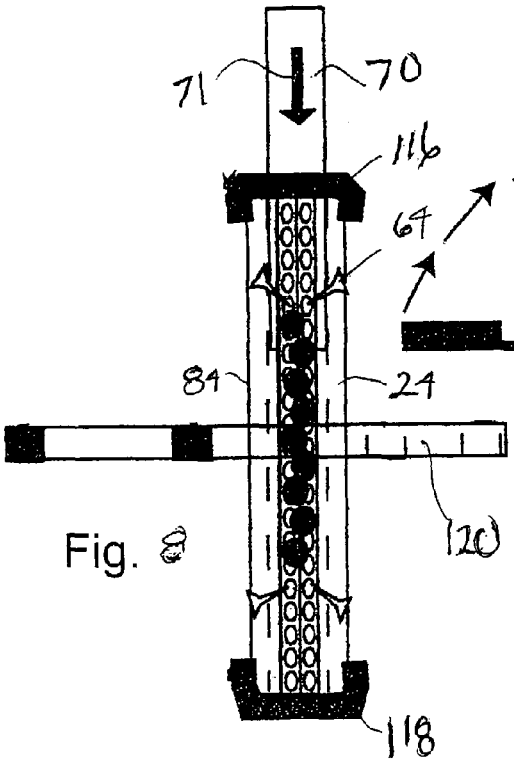
Fig. 8
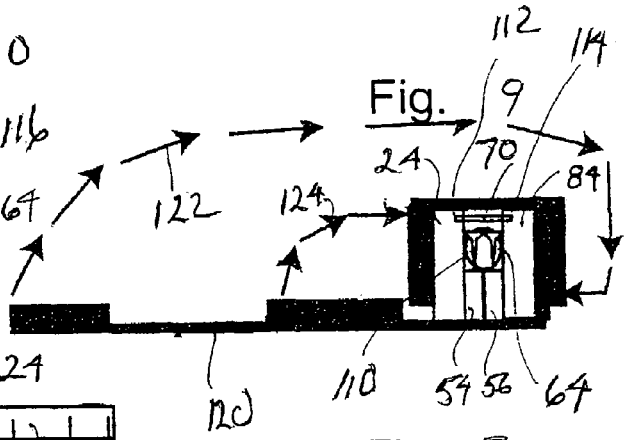
Fig. 7
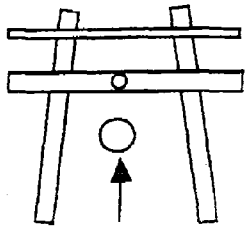

BALL GAME HAVING MEMBERS WITH PASSAGEWAYS

BACKGROUND OF THE INVENTION

This invention relates to game apparatuses and, in particular, to apparatuses for playing games with balls or marbles.

Various games have been developed in the past where a plurality of players roll balls (which term as used herein includes marbles) and score points. Game apparatuses for such games include passageways or apertures which serve as goals for the projectiles and frequently these passageways or apertures have numbered values. For example, U.S. Design Pat. No. 90,462 shows a structure having passageways with numbers above them. There are sides which extend perpendicular to the member with passageways. Also this Design patent shows a member behind the member with passageways. U.S. Pat. Nos. 1,223,256; 1,561,934 and 1,549,038 show similar games having passageways with numbers above them.

Also a series of games have been developed where players may intercept each other's projectiles as they are played. For example, in U.S. Pat. No. 4,033,585 to Foreman the game is played by directing a ball or similar projectile across the game board in a generally straight path. One or more players stationed along the game board attempt to strike and intercept the ball as it moves across the playing board.

Various patents show knockdown target ball games designed to be disassembled for portability. An example is found in U.S. Pat. No. 480,725.

Despite these earlier patents however, there is a continuing need for games which are unique and novel and are related to the use of balls. Also there is a need for providing such equipment in a form which can be readily carried and moved from one location to another.

Accordingly, it is an object of the invention to provide an improved game apparatus which players can use to play a number of new ball rolling games.

It is another object of the invention to provide an improved game apparatus which can be readily disassembled and carried in a compact form from one game playing site to another.

SUMMARY OF THE INVENTION

According to a first aspect of the invention, there is provided a game apparatus comprising a pair of side rails, a first passageway member having a bottom and a plurality of passageways communicating with the bottom. A second passageway member has a bottom and a plurality of passageways communicating with the bottom. There also is a backstop, the side rails having portions which are mutually engageable with the passageway members and the backstop when the side rails are positioned on a flat surface generally parallel and spaced-apart from each other. The first passageway member, the second passageway member and the backstop are spaced-apart from each other and extend perpendicular to the side rails. There is a plurality of balls, the balls being capable of passing through the passageways of the first and second passageway members when rolled towards the backstop.

According to a second aspect of the invention, there is provided a method of playing a game with an apparatus including a pair of side rails, each of the side rails having a top with a plurality of spaced-apart openings thereon to receive markers for keeping score of games played with the apparatus, a first passageway member having a bottom and a plurality of passageways communicating with the bottom, each of the passageways of the first passageway member having indicia indicating one or more game points, a backstop, the side rails having portions which are mutually engageable with the passageway member and the backstop when the side rails are positioned on a flat surface, parallel and spaced-apart from each other. The first passageway member and the backstop are spaced-apart from each other and extend perpendicular to the side rails. There is a plurality of balls, the balls being capable of passing through the passageways of the first passageway member when rolled towards the backstop. The method comprises providing each of a plurality of players with a plurality of the balls. Each player rolls balls towards the first passageway member and attempts to roll the balls through the passageways in the first passageway member. Each player moves a marker progressively further along one of the side rails when a player's ball passes through one of the passageways of the first passageway member. The game is awarded to a player who first moves a marker furthest along one of the side rails.

According to a third aspect of the invention, there is provided a method of playing a game with an apparatus including a pair of side rails, each of the side rails having a top with a plurality of spaced-apart openings thereon to receive markers for keeping score of games played with the apparatus. There is a first passageway member and a second passageway member, each of the passageway members having a bottom and a plurality of passageways communicating with the bottom, each of the passageways of the first passageway member having indicia indicating one or more game points. There is also a backstop, the side rails having portions which are mutually engageable with the passageway members and the backstop when the side rails are positioned on a flat surface parallel and spaced-apart from each other. The first passageway member, the second passageway member and the backstop are spaced-apart from each other, and extend perpendicular to the side rails, forming a first enclosed area between the side rails, the first passageway member and the second passageway member. There is a plurality of balls, the balls being capable of passing through the passageways of the first and second passageway members when rolled towards the backstop. The method comprises providing each of a plurality of players with a plurality of the balls. Each player rolls balls towards the first passageway member and attempts to roll the balls through the passageways in the first passageway member, but not through the passageways in the second passageway member. Each player moves a marker progressively further along one of the side rails when a player's ball passes through one of the passageways of the first passageway member. The game is awarded to a player who first moves a marker furthest along one of the side rails.

According to a fourth aspect of the invention, there is provided a method of playing a game with an apparatus including a pair of side rails, each of the side rails having a top with a plurality of spaced-apart openings thereon to receive markers for keeping score of games played with the apparatus. There is a first passageway member having a bottom and a plurality of passageways communicating with the bottom, each of the passageways having indicia indicating one or more game points. There is also a backstop, the side rails having portions which are mutually engageable with the passageway member and the backstop when the side rails are positioned on a flat surface, parallel and spaced-apart from each other. The first passageway member and the backstop are spaced-apart from each other, and extend perpendicular to the side rails, forming a first enclosed area between the side rails, the first passageway member and the backstop. There is a plurality of balls, the balls being capable of passing through the passageways of the first passageway member when rolled towards the backstop. The method comprises placing one of the balls on a side of the passageway member opposite the back stop and providing each of a plurality of players with a plurality of the balls. Each player rolls balls towards the first passageway member. Each player in turn acts alternatively as attacker and defender. The attacker attempts to roll the one ball through the passageways in the first passageway member and the defender attempts to prevent said one ball from rolling through the passageways in the first passageway member. Each player moves a marker progressively further along one of the side rails when a player's ball passes through one of the passageways of the first passageway member. The game is awarded to a player who first moves a marker furthest along one of the side rails.

According to a fifth aspect of the invention, there is provided a method of playing a game with an apparatus including a pair of side rails, each of the side rails having a top with a plurality of spaced-apart openings thereon to receive markers for keeping score of games played with the apparatus. There is a first passageway member having a bottom and a plurality of passageways communicating with the bottom, each of the passageways having indicia indicating one or more game points. There is also a backstop, the side rails having portions which are mutually engageable with the passageway member and the backstop when the side rails are positioned on a flat surface parallel and spaced-apart from each other. The first passageway member and the backstop are spaced-apart from each other, and extend perpendicular to the side rails. There is a plurality of balls, the balls being capable of passing through the passageways of the first passageway member when rolled towards the backstop. The method comprises providing each of a plurality of players with a plurality of the balls. A first said ball is positioned on a side of the first passageway member opposite the backstop. Each player rolls balls towards the first said ball and attempts to roll the said first ball through the passageways in the first passageway member. Each player moves a marker progressively further along one of the side rails when a player's ball passes through one of the passageways of the first passageway member. The game is awarded to a player who first moves a marker furthest along one of the side rails.

BRIEF DESCRIPTION OF THE DRAWINGS

In drawings which illustrate embodiments of the invention:

FIG. 1 is an isometric view of a game apparatus according to an embodiment of the invention shown assembled for playing a first game;

FIG. 2 is a simplified, top plan view thereof;

FIG. 3 is a simplified, fragmentary view of the passageway member thereof;

FIG. 4 is a view similar to FIG. 1, but showing the apparatus configured to play a second game;

FIG. 5 is a fragmentary, top plan view of the passageway members thereof;

FIG. 6 is a view similar to FIG. 1, but showing the apparatus assembled to play a third game;

FIG. 7 is a simplified, top plan view thereof;

FIG. 8 is a top plan view of the apparatus of FIG. 1 partly assembled for storage and transportation; and FIG. 9 is an end view thereof.

DETAILED DESCRIPTIONS OF THE PREFERRED EMBODIMENTS

Referring to the drawings and first to FIG. 1, game apparatus 20 includes a first passageway member 24 having opposite ends 26 and 28 and a bottom 30. A plurality of passageways 32, 34, 36, 38, 40, 42 and 44 extend upwardly from the bottom. The term "passageway" is used herein in the broadest sense to include rectangular openings as shown although the openings could be other shapes in other embodiments. Each of the passageways has indicia to indicate points associated therewith. For example, passageway 32 has indicia 48 in the form of the number "3". The remaining passageways have the numbers 2, 1, 5, 1, 2, and 3, respectively.

The passageway member has rectangular notches 50 and 52 near its opposite ends which engage a pair of side rails 54 and 56. It may be seen that the passageway member extends generally perpendicular to the side rails which are generally parallel to each other, but, as seen in FIG. 2, the side rails in this particular example are not completely parallel, but are slightly further apart adjacent to front 57 of the apparatus. The side rails 54 and 56 have tops 58 and 60 respectively with a plurality of spaced-apart openings 62 thereon to receive markers 64, shown only in FIGS. 8 and 9. The markers in this embodiments are in the form of golf tees. Two markers are provided for each player.

There is also a backstop 70 receivable in slots 72 and 74 in the side rails respectively. The slots in this example are angled acutely, as seen in FIG. 1, so top 71 of the backstop is sloped away from front 57 of the apparatus. The backstop also serves as a cover when the apparatus is in the storage position as shown in FIGS. 8 and 9.

The game apparatus also includes a plurality of balls, balls 78 and 80 being shown in FIG. 1. The balls in this example are glass marbles although other types of balls could be used instead. In this example six balls of a first color are provided for a first player, six balls of a second color for a second player and a single ball of a different color is designated a gate ball. It will be understood by someone skilled in the art that different numbers of balls could be provided in alternative embodiments.

The apparatus can be used to play different games. When assembled as shown in FIG. 1, it can be used to play a first game where the object of the game is for each player to roll a ball completely through one of the passageways in the passageway member. Points are awarded to the player according to the indicia above a particular passageway through which a ball passes.

In this game, each player has four balls. Such details as the number of balls however could be varied. Each player rolls one of the balls and the player who comes closest to the backstop 70, without touching it, plays first. The first player rolls four balls towards the backstop, one ball at a time. The player waits for each ball to come to a complete stop before rolling another. If a ball goes completely through any of the passageways in the passageway member, then the player keeps track of the points. This is done by moving the markers along the apertures 62 in the side rails. The markers are moved similar to cribbage where two markers are moved alternatively so that a record is kept of the previous position when new points are counted. The markers are moved from the far end of the side rails, adjacent the backstop.

If any ball does not pass completely through any openings in the passageway member, then it may remain on the playing surface until the player has rolled all four of his or her balls. After all four balls have been rolled, the player pegs his or her points and the next player plays in a similar manner. The first player having a marker which has moved furthest, in this case the marker which reaches the front of the apparatus, wins.

If a player causes a ball to jump over one of the side rails or the passageway member, then the player loses one point.

FIG. 3 illustrates, for clarity, that ball 78 has not passed completely through passageway member 24. However a ball 80 has completely passed through the passageway member.

FIGS. 4-5 illustrate the game apparatus 20 assembled for a second game. In this case there is a second passageway member 84, generally similar to passageway member 24, which is positioned parallel to the first passageway member and spaced-apart therefrom on the side opposite backstop 70. The object of the second game is for each player to roll balls, six in this example, one at a time, completely through the first passageway member 84, but not to roll them completely through the second passageway member 24.

The game is played by each player rolling one ball and the player rolling the ball closest to the backstop without touching it can select to play first or second. The players take turns rolling balls towards the backstop. When the last player rolls his or her sixth ball towards the backstop, then a frame is over. Each player counts how many balls are in the "battlefield" between the two passageway members and pegs his or her points on the side rails. If there is a tie after six completed frames, then play continues until a winner is found. Players can hit any or all balls in or out of the battlefield. In this game an elongated member 90, termed a gate key, extends through aperture 92 in the second passageway member to block the central passageway thereof.

FIGS. 6 and 7 show the apparatus 20 assembled for playing a third game. In this case only passageway member 24 is used with the gate key 92 in place. The object of the game is for each player, when acting as Defender, to roll a ball and try to prevent gate ball 100 from going completely through any of the passageways in passageway member 24. Another player, designated the Attacker, rolls a ball and tries to put the gate ball completely through one of the passageways.

The game starts in a manner similar to the games above. Each player has balls, six balls in this example, for each inning. Each player rolls one ball and the closest to the backstop, without touching the backstop, can choose to act as Defender or Attacker in the first inning. In the first inning, the Defender rolls one ball into play and leaves the ball as well as the gate ball on the playing surface. Next the Attacker rolls one ball and tries to put the gate ball completely through one of the passageways in the passageway member. If successful, the Attacker pegs one point. The gate ball is then repositioned to the initial position as shown in FIG. 6. The next inning starts and the player is alternate roles, the Attacker becoming the Defender and the Defender becoming the Attacker in the next inning.

If, however, the Attacker does not knock the gate ball completely through any of the passageways in the passageway member, then the gate ball and all of the other balls are left on the playing surface. The Defender rolls his or her second ball into play and leaves the balls and gate ball on the playing surface. Next the Attacker rolls his or her second ball and tries to put the gate ball completely through any openings in the passageway member and pegs one point. The gate ball is then repositioned and players change roles for the next inning. However if the gate ball is not completely through any of the passageways in the passageway member, then the gate ball and the other balls are left on the playing surface and the Defender plays the third ball. The players play their third, fourth, fifth and six balls and, if on the sixth ball the Attacker has not knocked the gate ball completely through one of the passageways in the passageway member, then the gate ball is left on the playing surface and the first inning is pegged. The players pick up six balls each from the playing surface and change roles for the second inning.

The gate ball is left anywhere on the playing surface and is only repositioned when a player scores a point. If a Defender cannot win after the fifth, sixth or seventh completed inning, the game is over. If there is a tie after eight completed innings then the players play additional innings until the tie is broken. All balls must come to a complete stop before the next roll.

When a player is acting as Defender, this is considered the bottom half of an inning. When a player is acting as Attacker, this is the top half of an inning. When each player has defended and attacked once, that is one completed inning. In the first inning the attacker moves his or her back peg up only one hole after the top of the first inning and, from the second inning through to the eighth inning, the attacker moves his or her peg up two holes after each inning.

In this and the previous games, the players could agree to terminate the game after a player has moved his or her marker a designated portion along one of the side rails instead of the entire length of one of the side rails.

Referring to FIGS. 8 and 9, the game apparatus can be assembled for storage and transportation. The passageway members 24 and 84 are positioned parallel and spaced-apart with the side rails 54 and 56 between the passageway members and parallel thereto. The markers 64 and balls, such as ball 110 in FIG. 9, are placed on top of the side rails. Backstop 70 is received in slots 112 and 114 in the passageway members 24 and 84 respectively and acts as a top to retain the balls and markers. The backstop slides into position between the slots as illustrated by arrow 71 in FIG. 8.

Hook and loop type fasteners 116 and 118 are receivable about ends of the passageways members to retain the balls and markers. There is also a second member, in this case another hook and loop type fastener 120, which is receivable about the passageway members, side rails and backstop to retain the apparatus together in the storage position. This member is shown unwrapped in FIGS. 8 and 9, the arrows 122 and 124 in FIG. 9 illustrating how this member is wrapped about the game apparatus for storage and transportation.

It will be understood by someone skilled in the art that many of the details provided above are by way of example only and can be varied or deleted without departing from the scope of the invention as set out in the following claims.

What is claimed is:

1. A gaming apparatus comprising:

a pair of side rails, each of the side rails having a top with a plurality of spaced-apart openings thereon to receive markers for keeping score of games played with the apparatus;

a first passageway member having a bottom and a plurality of passageways communicating with the bottom;

a second passageway member having a bottom and a plurality of passageways communicating with the bottom;

a backstop;

the side rails having portions which are mutually engageable with the passageway members and the backstop when the side rails are positioned on a flat surface generally parallel and spaced-apart from each other, the first passageway member, the second passageway member and the backstop being spaced-apart from each other and extending generally perpendicular to the side rails; and a plurality of balls, the balls being capable of passing through the passageways of the first and second passageway members when rolled towards the backstop.

2. A gaming apparatus comprising:

a pair of side rails;

a first passageway member having a bottom and a plurality of passageways communicating with the bottom;

a second passageway member having a bottom and a plurality of passageways communicating with the bottom;

a backstop;

the side rails having portions which are mutually engageable with the passageway members and the backstop when the side rails are positioned on a flat surface generally parallel and spaced-apart from each other, the first passageway member, the second passageway member and the backstop being spaced-apart from each other and extending generally perpendicular to the side rails;

a plurality of balls, the balls being capable of passing through the passageways of the first and second passageway members when rolled towards the backstop; and one of the passageway members having a central passageway and a blocking device for optionally preventing balls from passing through the central passageway.

3. The apparatus as claimed in claim 2, wherein the blocking device includes an aperture in said one of the passageway members and a pin extendable through the aperture.

4. A gaming apparatus comprising:

a pair of side rails;

a first passageway member having a bottom and plurality of passageways communicating with the bottom;

a second passageway member having a bottom and a plurality of passageways communicating with the bottom;

a backstop;

the side rails having portions which are mutually engageable with the passageway members and the backstop when the side rails are positioned on a flat surface generally parallel and spaced-apart from each other, the first passageway member, the second passageway member and the backstop being spaced-apart from each other and extending generally perpendicular to the side rails;

a plurality of balls, the balls being capable of passing through the passageways of the first and second passageway members when rolled towards the backstop; and wherein the apparatus has a storage position where the passageway members are parallel and spaced-apart, the side rails being between the passageway members and parallel thereto, the balls being receivable on the side rails and the backstop being receivable above the balls to retain the balls.

5. The apparatus as claimed in claim 4, including first members receivable about ends of the passageway members to retain the balls.

6. The apparatus as claimed in claim 5, wherein the first members receivable about the ends of the passageway members are hook and loop-type fasteners.

7. The apparatus as claimed in claim 6, including a second member receivable about the passageway members, side rails and backstop to retain the apparatus together in said storage position.

8. The apparatus as claimed in claim 7, wherein the second member is a hook and loop-type fastener.

9. A method of playing a game with an apparatus including a pair of side rails, each of the side rails having a top with a plurality of spaced-apart openings thereon to receive markers for keeping score of games played with the apparatus, a first passageway member having a bottom and a plurality of passageways communicating with the bottom, each of the passageways having indicia indicating one or more game points, a backstop, the side rails having portions which are mutually engageable with the passageway members and the backstop when the side rails are positioned on a flat surface generally parallel and spaced-apart from each other, the first passageway member, and the backstop being spaced-apart from each other and extending generally perpendicular to the side rails, and a plurality of balls, the balls being capable of passing through the passageways of the first and second passageway members when rolled towards the backstop, the method comprising:

providing each of a plurality of players with a plurality of the balls;

each player rolling balls towards the first passageway member and attempting to roll the balls through the passageways in the first passageway member;

each player moving a marker aggressively further along one of the side rails when a player's ball passes through one of the passageways of the first passageway member; and the game being awarded to a player who first moves a marker a designated amount along one of the side rails.

10. A method of playing a game with an apparatus including a pair of side rails, each of the side rails having a top with a plurality of spaced-apart openings thereon to receive markers for keeping score of games played with the apparatus, a first passageway member and a second passageway member, each of the passageway members having a bottom and a plurality of passageways communicating with the bottom, each of the passageways of the first passageway member having indicia indicating one or more game points, a backstop, the side rails having portions which are mutually engageable with the passageway members and the backstop when the side rails are positioned on a flat surface generally parallel and spaced-apart from each other, the first passageway member, the second passageway member and the backstop being spaced-apart from each other, and extending generally perpendicular to the side rails, forming a first enclosed area between the side rails, the first passageway member and the second passageway member, and a plurality of balls, the balls being capable of passing through the passageways of the first and second passageway members when rolled towards the backstop, the method comprising:

providing each of a plurality of players with a plurality of the balls;

each player rolling balls towards the first passageway member and attempting to roll the balls through the passageways in the first passageway member, but not through the passageways in the second passageway member;

each player moving a marker progressively further along one of the side rails when a player's ball passes through one of the passageways of the first passageway member, but not through the passageways in the second passageway member; and the game being awarded to a player who first moves a marker a designated amount along one of the side rails.

11. A method of playing a game with an apparatus including a pair of side rails, each of the side rails having a top with a plurality of spaced-apart openings thereon to receive markers for keeping score of games played with the apparatus, a first passageway member having a bottom and a plurality of passageways communicating with the bottom, each of the passageways having indicia indicating one or more game points, a backstop, the side rails having portions which are mutually engageable with the passageway member and the backstop when the side rails are positioned on a flat surface generally parallel and spaced-apart from each other, the first passageway member, and the backstop being spaced-apart from each other and extending generally perpendicular to the side rails, and a plurality of balls, the balls being capable of passing through the passageways of the first passageway member when rolled towards the backstop, the method comprising:

placing one of the balls on a side of the passageway member opposite the back stop;

providing each of a plurality of players with a plurality of the balls;

each player rolling balls towards the first passageway member;

said each player in turn acting alternatively as attacker and defender, the attacker attempting to roll said one ball through the passageways in the first passageway member and the defender attempting to prevent said one ball from rolling through the passageways in the first passageway member;

each player moving a marker progressively further along one of the side rails when a player is said attacker and said attacker's ball passes through one of the passageways of the first passageway member; and the game being awarded to a player who first moves a marker a designated amount along one of the side rails.

12. A method of playing a game with an apparatus including a pair of side rails, each of the side rails having a top with a plurality of spaced-apart openings thereon to receive markers for keeping score of games played with the apparatus, a first passageway member having a bottom and a plurality of passageways communicating with the bottom, each of the passageways having indicia indicating one or more game points, a backstop, the side rails having portions which are mutually engageable with the first passageway member and the backstop when the side rails are positioned an a flat surface generally parallel and spaced-apart from each other, the first passageway member, and the backstop being spaced-apart from each other and extending generally perpendicular to the side rails, and a plurality of balls, the balls being capable of passing through the passageways of the first passageway member when rolled towards the backstop, the method comprising:

providing each of a plurality of players with a plurality of the balls;

positioning a first said ball on the side of the passageway member opposite the backstop;

each player rolling balls towards the first said ball and attempting to roll the said first ball through the passageways in the first passageway member;

each player moving a marker progressively further along one of the side rails when a player's ball moves said first ball through one of the passageways of the first passageway member; and the game being awarded to a player who first moves a marker a designated amount along one of the side rails.

* * * * *